US007287824B2

(12) United States Patent
Subirada et al.

(10) Patent No.: US 7,287,824 B2
(45) Date of Patent: Oct. 30, 2007

(54) METHOD AND APPARATUS FOR ASSESSING NOZZLE HEALTH

(75) Inventors: Francesc Subirada, Barcelona (ES); Joan Manuel Garcia, Barcelona (ES); Santiago Garcia Reyero, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 516 days.

(21) Appl. No.: 10/892,712

(22) Filed: Jul. 16, 2004

(65) Prior Publication Data

US 2006/0012806 A1 Jan. 19, 2006

(51) Int. Cl.
*B41J 29/393* (2006.01)

(52) U.S. Cl. ..... 347/19

(58) Field of Classification Search ..... 347/19, 347/14, 41; 358/406
See application file for complete search history.

(56) References Cited

U.S. PATENT DOCUMENTS

| | | | | |
|---|---|---|---|---|
| 6,037,584 | A | 3/2000 | Johnson et al. | |
| 6,164,750 | A | 12/2000 | Subirada et al. | |
| 6,312,098 | B1 | 11/2001 | Miquel et al. | |
| 6,443,556 | B1 | 9/2002 | Garcia et al. | |
| 6,542,258 | B1 | 4/2003 | Garcia et al. | |
| 6,543,871 | B1 * | 4/2003 | Rosen et al. | 347/15 |
| 6,637,853 | B1 * | 10/2003 | Ahne et al. | 347/19 |
| 2004/0141209 | A1 * | 7/2004 | Marumoto et al. | 358/3.26 |
| 2005/0024406 | A1 * | 2/2005 | Otsuki | 347/14 |

* cited by examiner

*Primary Examiner*—Lamson Nguyen

(57) ABSTRACT

A technique for assessing nozzle health of a printhead nozzle array in a printing system includes printing a swath portion of an image, optically scanning the printed swath portion to capture a scanned image, comparing an expected image of the swath portion of the image with the scanned image, and assessing whether any nozzles of the nozzle array have malfunctioned. A sensor can be mounted on a printhead carriage to accomplish the image capture.

27 Claims, 5 Drawing Sheets

METHOD AND APPARATUS FOR ASSESSING NOZZLE HEALTH

BACKGROUND

Inkjet printers employ printheads for ejecting ink through nozzles of fluid drop generators onto a print media. For various reasons, the fluid ejectors or nozzles can fail to operate properly, which can adversely affect print quality. Nozzle health tests can be done to detect nozzles which are not operating normally. It is known to use isolated drop detection systems with optical detectors to detect nozzle health during special test modes. These systems are expensive and use up ink and time for the testing.

BRIEF DESCRIPTION OF THE DRAWINGS

Features and advantages of the disclosure will readily be appreciated by persons skilled in the art from the following detailed description when read in conjunction with the drawing wherein.

DETAILED DESCRIPTION

Figure 1:
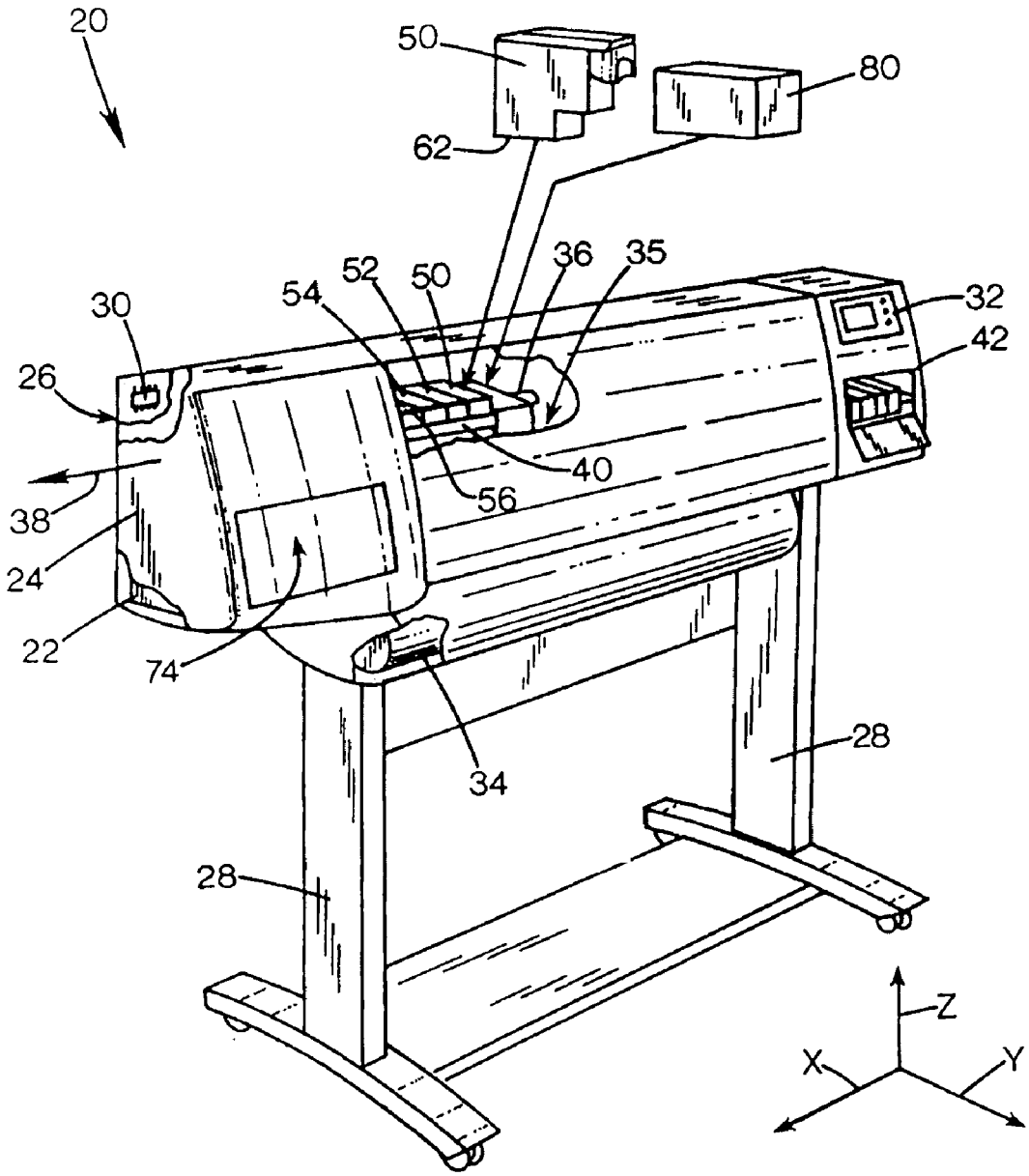
FIG. 1 illustrates an embodiment of a printer.

In the following detailed description and in the several figures of the drawing, like elements are identified with like reference numerals.

For simplicity and illustrative purposes, the principles of the present invention are described by referring mainly to an exemplary embodiment thereof. In the following description, numerous specific details are set forth in order to provide a thorough understanding of the present invention. It will be apparent however, to one of ordinary skill in the art, that the present invention may be practiced without limitation to these specific details. In other instances, well known methods and structure have not been described in detail so as to not to unnecessarily obscure the disclosure.

As used throughout the present disclosure, the terms "optical scanner" generally refer to a scanner module for image capturing. One exemplary embodiment of optical scanner includes an image capturing device such as a CCD for capturing images from a print media.

FIG. 1 illustrates an embodiment of a printer 20, which may be used for recording information onto a recording medium, such as paper, textiles, and the like, in an industrial, office, home or other environment. Embodiments of a nozzle health assessment technique disclosed herein may be practiced in a variety of printers. For instance, it is contemplated that an embodiment may be practiced in large scale textile printers, desk top printers, portable printing units, copiers, cameras, video printers, and facsimile machines, to name a few. For convenience, the concepts of the nozzle heath assessment techniques are illustrated in the environment of the printer 20.

While the printer components may vary from model to model, the printer 20 includes a chassis 22 surrounded by a housing or casing enclosure 24, typically of a plastic material, together forming a print assembly portion 26 of the printer 20. Additionally, the print assembly portion 26 may be supported by a desk or tabletop, however; however in this embodiment, the print assembly portion 26 is supported with a pair of leg assemblies 28. The printer 20 also has a printer controller 30, illustrated schematically as a microprocessor, that receives instructions from a host device (not shown), typically a computer, such as a personal computer or a computer aided drafting (CAD) computer system. The printer controller 30 may also operate in response to user inputs provided through a key pad and a status display portion 32, located on the exterior of the casing 24. A monitor coupled to the host device may also be used to display visual information to an operator, such as the printer status or a particular program being run on the host device. Personal and drafting computers, their input devices, such as a keyboard and/or a mouse device, and monitors are all well known to those skilled in the art.

A recording media handling system may be used to advance a continuous sheet of recording media 34 from a roll through a print zone 35. Moreover, the illustrated printer 20 may also be used for printing images on pre-cut sheets, ratherthan on media supplied in roll 34. The recording media may be any type of suitable sheet material, such as paper, poster board, fabric, transparencies, mylar, vinyl, and the like. A carriage guide rod 36 is mounted to the chassis 22 to define a scanning axis 38, with the guide rod 36 slideably supporting a carriage 40 for travel back and forth, reciprocally, across the print zone 35. A carriage drive motor (not shown) may be used to propel the carriage 40 in response to a control signal received from the controller 30. To provide carriage positional feedback information to controller 30, an encoder strip (not shown) may be extended along the length of the print zone 35 and over a servicing region 42.

An optical encoder reader may be mounted on the back surface of carriage 40 to read positional information provided by the encoder strip. The manner of providing positional feedback information via the encoder strip reader, may be accomplished in a variety of ways.

The printer 20 of this exemplary embodiment includes four print cartridges 50-56. In the print zone 35, the recording medium receives ink from cartridges 50-56. The cartridges 50-56 are also often called "pens" by those in the art. One of the pens, for example pen 56, may be configured to eject black ink onto the recording medium, where the black ink may contain a pigment-based or a dye-based ink. Pens 50-54 may be configured to eject variously colored inks, e.g., yellow, magenta, cyan, light cyan, light magenta, blue, green, red, to name a few. For the purposes of illustration, pens 50-54 are described as each containing a dye-based ink of the colors yellow, magenta and cyan, respectively, although it is apparent that the color pens 50-54 may also contain pigment-based inks in some implementations. It is apparent that other types of inks may also be used in the pens 50-56, such as paraffin-based inks, as well as hybrid or composite inks having both dye and pigment characteristics.

The printer 20 of this exemplary embodiment uses an "off-axis" ink delivery system, having main stationary reservoirs (not shown) for each ink (black, cyan, magenta, yellow) located in an ink supply region 74. In this respect, the term "off-axis" generally refers to a configuration where the ink supply is separated from the print heads 50-56. In this off-axis system, the pens 50-56 may be replenished by ink conveyed through a series of flexible tubes (not shown) from the main stationary reservoirs so only a small ink supply is propelled by carriage 40 across the print zone 35 which is located "off-axis" from the path of printhead travel. As used herein, the term "pen" or "cartridge" may also refer to replaceable printhead cartridges where each pen has a reservoir that carries the entire ink supply as the printhead reciprocates over the print zone.

Figure 2:
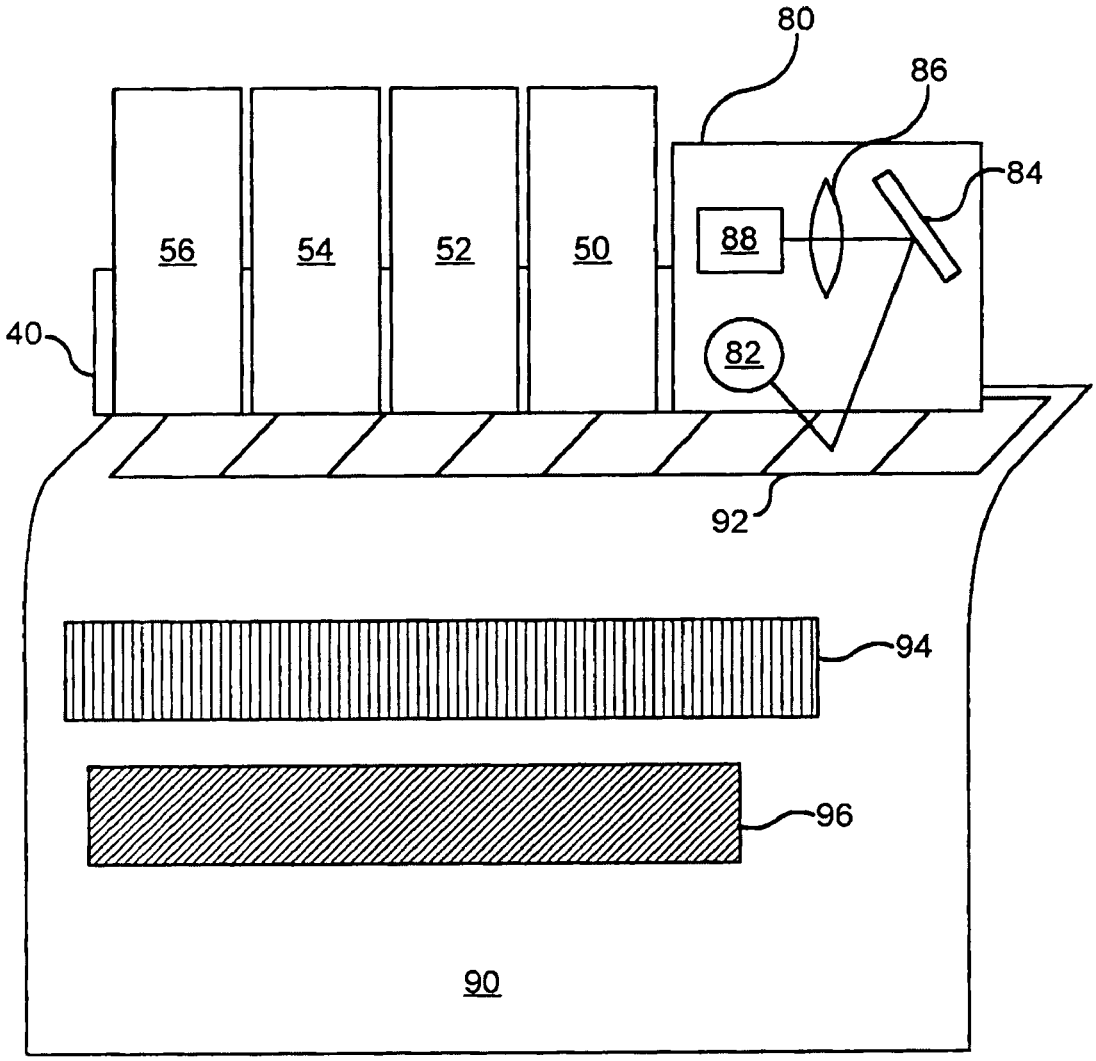
FIG. 2 is a close-up simplified cross-sectional view of the carriage portion of the printing mechanism of FIG. 1 showing a carriage-mounted optical scanner.
Figure 2B:
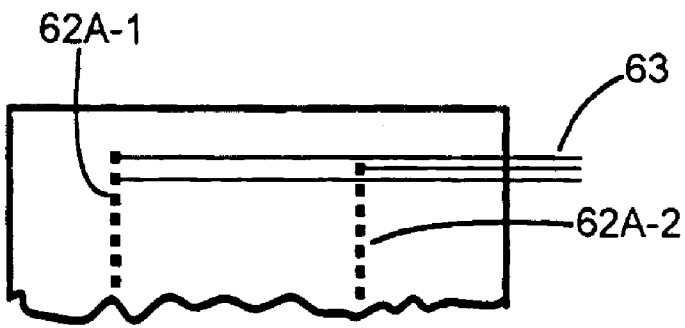
FIG. 2B is an enlarged fragmentary view of a portion of FIG. 2A, showing rows printed by the staggered nozzles of the two arrays.
Figure 2A:
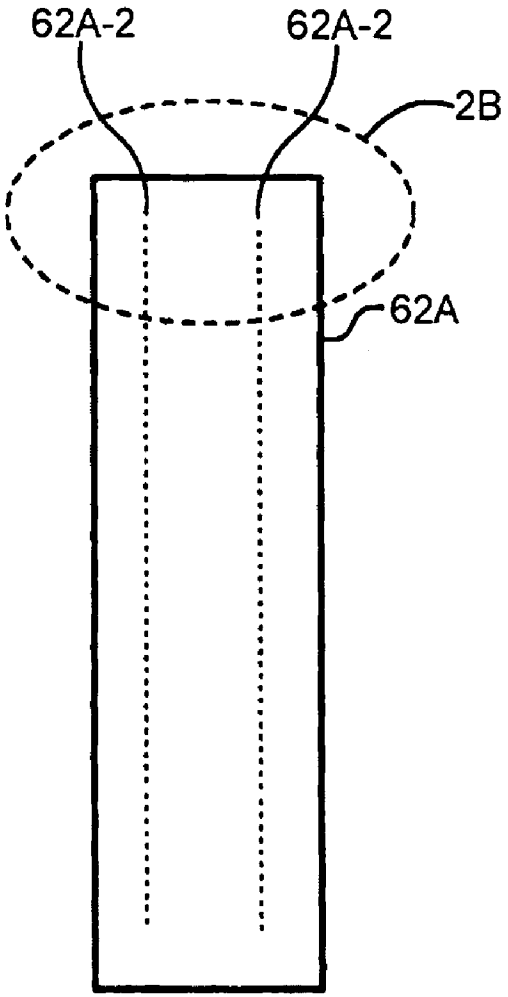
FIG. 2A shows in diagrammatic plan view an exemplary orifice plate with a plurality of nozzles.

The illustrated pens 50-56 have printheads, e.g. printhead 62, which selectively eject ink to form an image on a sheet of media 34 in the print zone 35. In an exemplary embodiment, these printheads have a large print swath, for instance about 22.5 millimeters high or higher, although the concepts described herein may also be applied to smaller printheads. In an exemplary embodiment, the printheads each have an orifice plate with a plurality of nozzles formed there through. FIG. 2A shows in diagrammatic plan view an exemplary orifice plate 62 A with a plurality of nozzles.

The nozzles of each printhead are typically formed in at least one, but typically two or more linear arrays along the orifice plate. For example, as shown in FIG. 2A, the nozzles are formed in linear arrays 62 A-1 and 62 A-2. The term "linear" as used herein may be interpreted as "nearly linear" or substantially linear, and may include nozzle arrangements slightly offset from one another, for example, in a zigzag arrangement. Each linear array is typically aligned in a longitudinal direction substantially perpendicular to the scanning axis 38, with the length of each array determining the maximum image swath for a single pass of the printhead. The arrays can be staggered with respect to each other, so that an offset along the longitudinal direction enables higher resolution printing. For example, say the nozzles in array 62 A-1 and array 62 A-2 are spaced by 1/300 inch or 1/600 inch spacings. With th staggered array feature, the resolution can be increased to 1/600 or 1/1200, or to 600 dpi or 1200 dpi. FIG. 2B is an enlarged fragmentary view of the indicated region of FIG. 2A, showing rows 63 printed by the staggered nozzles of the two arrays.

The printer 20 also includes an optical scanner 80 configured to scan across images printed by the pens 50-56. As shown in FIG. 2, in this embodiment of the printer 20, the optical scanner 80 is connected to the carriage 40. The optical scanner 80 may be connected to the carriage 40 in any reasonably suitable manner that enables the optical scanner to scan over the print zone 35 in a manner that follows the movement of the pens 50-56 (i.e., the optical scanner is in line with the pens). In an exemplary embodiment, the optical scanner is on a side of the pens which is downstream of the printing. If the printer supports bidirectional printing, i.e. printing each swath movement direction, then two optical scanners may be used, one on each side of the pens along a swath movement direction so that the just printed image portions can be scanned and captured by one of the optical scanners.

For high quality full-color printing, the colors from the individual pens should be precisely applied to the printing medium, and this generally means that the pens should be precisely aligned with the carriage assembly. Paper slippage, paper skew, and mechanical misalignment of the pens in inkjet printing mechanisms often result in offsets along both the medium or paper-advance axis and the scan or carriage axis. A group of test patterns can be generated (by activation of selected nozzles in selected pens while the carriage scans across the print medium 90 ) whenever any of pens is distributed, e.g., just after a pen is replaced. The test patterns are then read by scanning the optical scanner 80 over them and analyzing the results.

In an exemplary embodiment, the optical scanner can be used to perform nozzle health assessment. The optical scanner 80 senses the pixel patterns laid down by the pens 50-56 in normal printing modes, and provides electrical signals to, for example, processor 30, indicative of the portions of the image in the field of view of the scanner 80 which has been printed on the medium 92. The optical scanner 80 may include a field of view having a height substantially equal to the swath height of the nozzle arrays of the pens. It is, however, envisioned that the field of view of the optical scanner 80 may be relatively greater than the swath height of the pens 50-56.

In an exemplary embodiment, the optical scanner 80 may comprise a charge coupled device (CCD) scanner that is sized to fit on the carriage 40. The optical scanner 80 includes a light source 82, one or more reflective surfaces 84 (only one reflective surface is illustrated), a light focusing device 86, and a CCD 88. The optical scanner 80 captures images by illuminating the images with the light source 82 and sensing reflected light with the CCD 88. The CCD 88 may be configured to include various channels (e.g., red, green, and blue) to detect various colors using a single lamp or a one channel CCD (monochrome) with various color sources (e.g., light emitting diodes (LED)). A more detailed description of one exemplary manner in which the CCD 88 may operate to detect pixels of an image may be found in U.S. Pat. No. 6,037,584. The disclosure contained in that patent is hereby incorporated by reference in its entirety.

Figure 3:
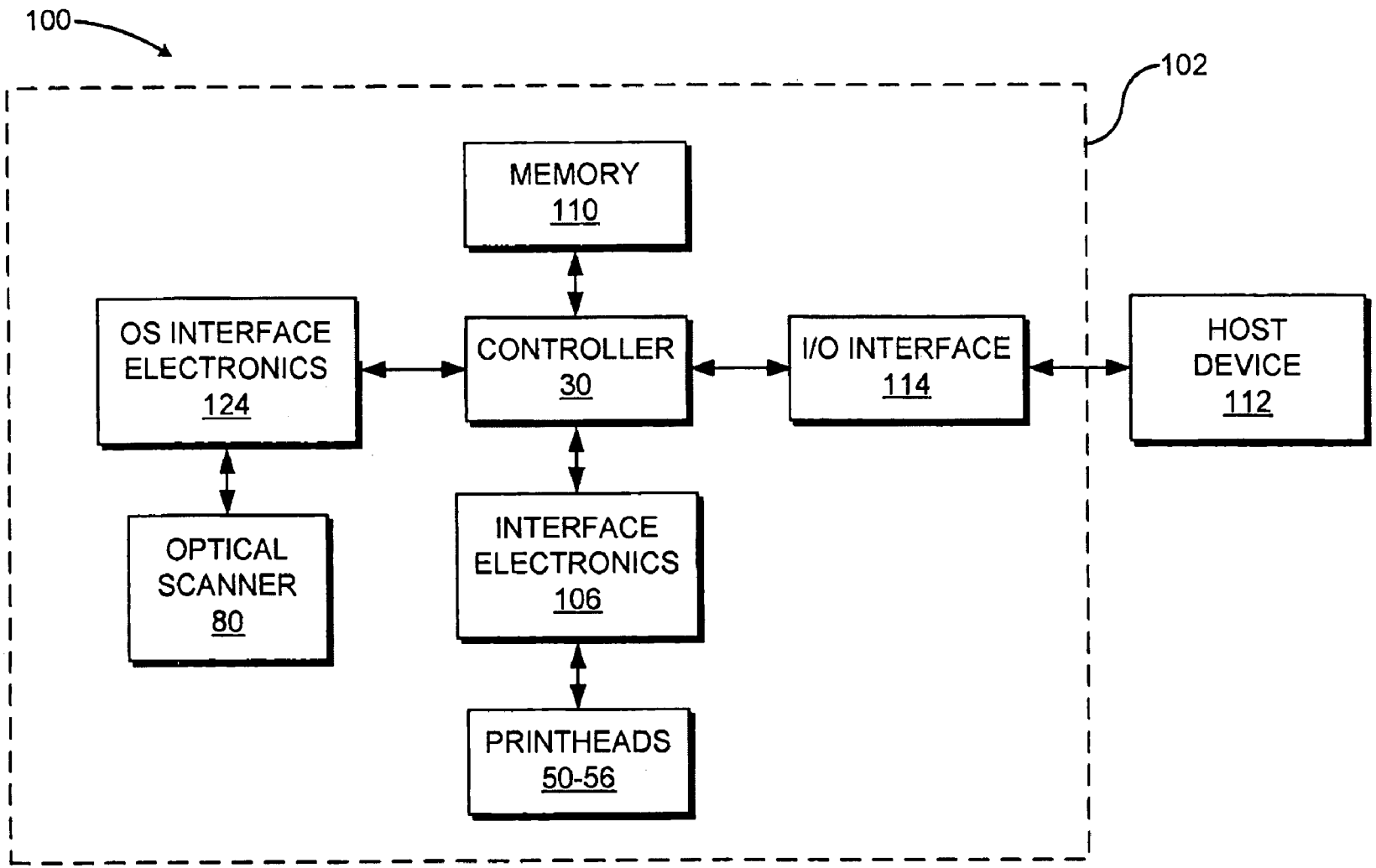
FIG. 3 is an exemplary block diagram of a printing system with an optical scanner.

Referring to FIG. 3, there is illustrated an exemplary block diagram of elements of an embodiment of the printer 20. The following description illustrates one exemplary manner in which a printer 20 having an optical scanner 80 may be operated. In this respect, it is to be understood that the following description of FIG. 3 is but one manner of a variety of different manners in which such a printer 20 may be operated.

The printer 20 is shown as including four printheads 50-56. However, the nozzle health assessment techniques described herein may operate with a single printhead, or with more than one printheads.

The printer 20 may also include interface electronics 306 configured to provide an interface between the controller 30 and the components for moving the carriage 40, e.g., encoder, belt and pulley system (not shown), etc. The interface electronics 306 may include, for example, circuits for moving the carriage, the medium, firing individual nozzles of each printhead, and the like.

The controller 30 may be configured to provide control logic to implement programmed processes for the printer 20, e.g. to serve as a print engine, which provides the functionality for the printer. In this respect, the controller 30 may be implemented by a microprocessor, a micro-controller, an application specific integrated circuit (ASIC), and the like. The controller 30 may be a computer program product interfaced with a memory 110 configured to provide storage of a computer software, e.g. a computer readable code means, that provides the functionality of the printer 20 and may be executed by the controller. The memory 110 may also be configured to provide a temporary storage area for data/files received by the printer 20 from a host device 112, such as a computer, server, workstation, and the like. The memory 110 may be implemented as a combination of volatile and non-volatile memory, such as dynamic random access memory ("RAM"), EEPROM, flash memory, hard drive storage and the like. Alternatively the memory 110 may be included in the host device 112.

The controller 30 may further be interfaced with an I/O interface 114 configured to provide a communication channel between the host device 112 and the printer 20. The I/O interface 112 may conform to protocols such as RS-232, parallel, small computer system interface, universal serial bus, etc.

Optical scanner interface electronics 124 may interface the optical scanner 304 and the controller 30. The optical scanner interface electronics 124 may operate to convert instruction signals from the controller 30 to the optical scanner 304. In addition, the optical scanner interface electronics 124 may also operate to convert information sensed by the optical scanner 304 into a format capable of being interpreted by the controller 30.

An exemplary embodiment of a nozzle health assessment technique uses the scanner 80 on the carriage in order to detect changes in nozzle health. The scanner is attached to the carriage, so it scans the same data being printed. That means that after a pass of a swath has been completely printed, the printer will have stored in memory the original image data (i.e. the image to be printed in the swath), the image portion to be printed this pass, and the scanned image. All the other images corresponding to the passes that are not being printed do not have to be stored in memory, as the original image data can be "anded" with the print mask at every pass. The scanned version of the image contains all the artifacts derived from the ink-on-paper interaction. One of those artifacts is nozzle health.

In an exemplary embodiment, a print mode is used to print an image. One of the parameters of the print mode is the number of passes needed to print the image. For an n-pass print mode the printer uses n passes to finish a given swath. This means that at every printing pass only one nth of the dots are being printed. The splitting of the image data in passes is done using a print mode mask. This mask contains the pass number when each pixel is going to be printed. Then this mask is converted into 'n' binary masks that are logically "anded" with the image data. If there is a '1' value in the same position for the image and for the mask, a drop is going to be fired.

The following is an example of how this works. Assume that the image to be printed is the following:

| | | | | | | | | |
|---|---|---|---|---|---|---|---|---|
| 0 | 0 | 0 | 0 | 1 | 0 | 0 | 0 | 0 |
| 0 | 0 | 0 | 1 | 1 | 1 | 0 | 0 | 0 |
| 0 | 0 | 1 | 1 | 1 | 1 | 1 | 0 | 0 |
| 0 | 1 | 1 | 1 | 1 | 1 | 1 | 1 | 0 |
| 1 | 1 | 1 | 1 | 1 | 1 | 1 | 1 | 1 |
| 0 | 1 | 1 | 1 | 1 | 1 | 1 | 1 | 0 |
| 0 | 0 | 1 | 1 | 1 | 1 | 1 | 0 | 0 |
| 0 | 0 | 0 | 1 | 1 | 1 | 0 | 0 | 0 |

For this example, a 4-pass print mode mask is employed, splitting the printing into 4 binary masks:

| | | | | | | | | |
|---|---|---|---|---|---|---|---|---|
| 1 | 2 | 3 | 4 | 1 | 2 | 3 | 4 | 1 |
| 3 | 4 | 1 | 2 | 3 | 4 | 1 | 2 | 3 |
| 1 | 2 | 3 | 4 | 1 | 2 | 3 | 4 | 1 |
| 4 | 1 | 2 | 3 | 4 | 1 | 2 | 3 | 4 |
| 2 | 3 | 4 | 1 | 2 | 3 | 4 | 1 | 2 |
| 1 | 2 | 3 | 4 | 1 | 2 | 3 | 4 | 1 |
| 3 | 4 | 1 | 2 | 3 | 4 | 1 | 2 | 3 |
| 1 | 2 | 3 | 4 | 1 | 2 | 3 | 4 | 1 |

For pass 1, the print mode mask is as follows:

| | | | | | | | | |
|---|---|---|---|---|---|---|---|---|
| 1 | 0 | 0 | 0 | 1 | 0 | 0 | 0 | 1 |
| 0 | 0 | 1 | 0 | 0 | 0 | 1 | 0 | 0 |
| 1 | 0 | 0 | 0 | 1 | 0 | 0 | 0 | 1 |
| 0 | 1 | 0 | 0 | 0 | 1 | 0 | 0 | 0 |
| 0 | 0 | 0 | 1 | 0 | 0 | 0 | 1 | 0 |
| 1 | 0 | 0 | 0 | 1 | 0 | 0 | 0 | 1 |
| 0 | 0 | 1 | 0 | 0 | 0 | 1 | 0 | 0 |
| 1 | 0 | 0 | 0 | 1 | 0 | 0 | 0 | 1 |

For pass 2, the print mode mask is as follows:

| | | | | | | | | |
|---|---|---|---|---|---|---|---|---|
| 0 | 1 | 0 | 0 | 0 | 1 | 0 | 0 | 0 |
| 0 | 0 | 0 | 1 | 0 | 0 | 0 | 1 | 0 |
| 0 | 1 | 0 | 0 | 0 | 1 | 0 | 0 | 0 |
| 0 | 0 | 1 | 0 | 0 | 0 | 1 | 0 | 0 |
| 1 | 0 | 0 | 0 | 1 | 0 | 0 | 0 | 1 |
| 0 | 1 | 0 | 0 | 0 | 1 | 0 | 0 | 0 |
| 0 | 0 | 0 | 1 | 0 | 0 | 0 | 1 | 0 |
| 0 | 1 | 0 | 0 | 0 | 1 | 0 | 0 | 0 |

For pass 3, the print mode mask is as follows:

| | | | | | | | | |
|---|---|---|---|---|---|---|---|---|
| 0 | 0 | 1 | 0 | 0 | 0 | 1 | 0 | 0 |
| 1 | 0 | 0 | 0 | 1 | 0 | 0 | 0 | 1 |
| 0 | 0 | 1 | 0 | 0 | 0 | 1 | 0 | 0 |
| 0 | 0 | 0 | 1 | 0 | 0 | 0 | 1 | 0 |
| 0 | 1 | 0 | 0 | 0 | 1 | 0 | 0 | 0 |
| 0 | 0 | 1 | 0 | 0 | 0 | 1 | 0 | 0 |
| 1 | 0 | 0 | 0 | 1 | 0 | 0 | 0 | 1 |
| 0 | 0 | 1 | 0 | 0 | 0 | 1 | 0 | 0 |

For pass 4, the print mode mask is as follows:

| | | | | | | | | |
|---|---|---|---|---|---|---|---|---|
| 0 | 0 | 0 | 1 | 0 | 0 | 0 | 1 | 0 |
| 0 | 1 | 0 | 0 | 0 | 1 | 0 | 0 | 0 |
| 0 | 0 | 0 | 1 | 0 | 0 | 0 | 1 | 0 |
| 1 | 0 | 0 | 0 | 1 | 0 | 0 | 0 | 1 |
| 0 | 0 | 1 | 0 | 0 | 0 | 1 | 0 | 0 |
| 0 | 0 | 0 | 1 | 0 | 0 | 0 | 1 | 0 |
| 0 | 1 | 0 | 0 | 0 | 1 | 0 | 0 | 0 |
| 0 | 0 | 0 | 1 | 0 | 0 | 0 | 1 | 0 |

So, the image data applied every pass is:

| | | | | | | | | |
|---|---|---|---|---|---|---|---|---|
| 0 | 0 | 0 | 0 | 1 | 0 | 0 | 0 | 0 |
| 0 | 0 | 0 | 1 | 1 | 1 | 0 | 0 | 0 |
| 0 | 0 | 1 | 1 | 1 | 1 | 1 | 0 | 0 |
| 0 | 1 | 1 | 1 | 1 | 1 | 1 | 1 | 0 |
| 1 | 1 | 1 | 1 | 1 | 1 | 1 | 1 | 1 |
| 0 | 1 | 1 | 1 | 1 | 1 | 1 | 1 | 0 |
| 0 | 0 | 1 | 1 | 1 | 1 | 1 | 0 | 0 |
| 0 | 0 | 0 | 1 | 1 | 1 | 0 | 0 | 0 |

At pass 1, anding the image data with the first pass mask results in:

| | | | | | | | | |
|---|---|---|---|---|---|---|---|---|
| 0 | 0 | 0 | 0 | 1 | 0 | 0 | 0 | 0 |
| 0 | 0 | 0 | 0 | 0 | 0 | 0 | 0 | 0 |
| 0 | 0 | 0 | 0 | 1 | 0 | 0 | 0 | 0 |
| 0 | 1 | 0 | 0 | 0 | 1 | 0 | 0 | 0 |

-continued

| | | | | | | | | |
|---|---|---|---|---|---|---|---|---|
| 0 | 0 | 0 | 1 | 0 | 0 | 0 | 1 | 0 |
| 0 | 0 | 0 | 0 | 1 | 0 | 0 | 0 | 0 |
| 0 | 0 | 1 | 0 | 0 | 0 | 1 | 0 | 0 |
| 0 | 0 | 0 | 0 | 1 | 0 | 0 | 0 | 0 |

At pass 2, anding the image with the second pass mask results in:

| | | | | | | | | |
|---|---|---|---|---|---|---|---|---|
| 0 | 0 | 0 | 0 | 0 | 0 | 0 | 0 | 0 |
| 0 | 0 | 0 | 1 | 0 | 0 | 0 | 0 | 0 |
| 0 | 0 | 0 | 0 | 0 | 1 | 0 | 0 | 0 |
| 0 | 0 | 1 | 0 | 0 | 0 | 1 | 0 | 0 |
| 1 | 0 | 0 | 0 | 1 | 0 | 0 | 0 | 1 |
| 0 | 1 | 0 | 0 | 0 | 1 | 0 | 0 | 0 |
| 0 | 0 | 0 | 1 | 0 | 0 | 0 | 0 | 0 |
| 0 | 0 | 0 | 0 | 0 | 1 | 0 | 0 | 0 |

At pass 3, anding the image with the third pass mask results in:

| | | | | | | | | |
|---|---|---|---|---|---|---|---|---|
| 0 | 0 | 0 | 0 | 0 | 0 | 0 | 0 | 0 |
| 0 | 0 | 0 | 0 | 1 | 0 | 0 | 0 | 0 |
| 0 | 0 | 1 | 0 | 0 | 0 | 1 | 0 | 0 |
| 0 | 0 | 0 | 1 | 0 | 0 | 0 | 1 | 0 |
| 0 | 1 | 0 | 0 | 0 | 1 | 0 | 0 | 0 |
| 0 | 0 | 1 | 0 | 0 | 0 | 1 | 0 | 0 |
| 0 | 0 | 0 | 0 | 1 | 0 | 0 | 0 | 0 |
| 0 | 0 | 0 | 0 | 0 | 0 | 0 | 0 | 0 |

At pass 4, anding the image with the fourth pass print mask results in:

| | | | | | | | | |
|---|---|---|---|---|---|---|---|---|
| 0 | 0 | 0 | 0 | 0 | 0 | 0 | 0 | 0 |
| 0 | 0 | 0 | 0 | 0 | 1 | 0 | 0 | 0 |
| 0 | 0 | 0 | 1 | 0 | 0 | 0 | 0 | 0 |
| 0 | 0 | 0 | 0 | 1 | 0 | 0 | 0 | 0 |
| 0 | 0 | 1 | 0 | 0 | 0 | 1 | 0 | 0 |
| 0 | 0 | 0 | 1 | 0 | 0 | 0 | 1 | 0 |
| 0 | 0 | 0 | 0 | 0 | 1 | 0 | 0 | 0 |
| 0 | 0 | 0 | 1 | 0 | 0 | 0 | 0 | 0 |

So, after four passes, the first two rows have been printed with all the 4 passes, the rows 3 and 4 have been printed only with passes 1, 2 and 3, rows 5 and 6 with passes 1 and 2 and rows 7 and 8 only with pass 1. Assume that, in this exemplary embodiment, the print medium advance system is actuated to advance the print medium by two rows between each pass. So, what is to be scanned is:

after passes 1, 2, 3 and 4:

Row 1 0 0 0 0 1 0 0 0 0
Row 2 0 0 0 1 1 1 0 0 0
after passes 1, 2, and 3:

Row 3 0 0 1 0 1 1 1 0 0
Row 4 0 1 1 1 0 1 1 1 0
after passes 1 and 2:

Row 5 1 0 0 1 1 0 0 1 1
Row 6 0 1 0 0 1 1 0 0 0

-continued after pass 1:

Row 7 0 0 1 0 0 0 1 0 0
Row 8 0 0 0 0 1 0 0 0 0

In this example for a 4-pass print mode, the print medium is advanced four times, i.e. once per pass, in order to print the complete swath. At every pass in this example, there is only one nozzle printing every row, so after the four advances, four nozzles have printed the same row. So after each pass, the scanner can observe if a nozzle is dead because there is no ink (or not enough ink) on a given row. The expected printed image (the respective images in the tables above) can be compared with the scanned image. If a nozzle is missing, it can be detected when comparing both images because of the lower density in a given row and in expected firing positions of this nozzle. This information can be used to modify the print masks to compensate for inoperative nozzles or nozzles which are not operating properly. Alternatively, detection of malfunctioning masks could trigger a printhead service routine, e.g. spitting and wiping, at a printer service station.

The nozzle health assessment technique can also be employed with a single pass print mode, wherein the entire swath is printed with a single pass of the printhead carriage. In a single pass print mode, all the nozzles are ready to print, and so if a nozzle is not printing, the scanned image can be processed to detect this condition.

Figure 4:
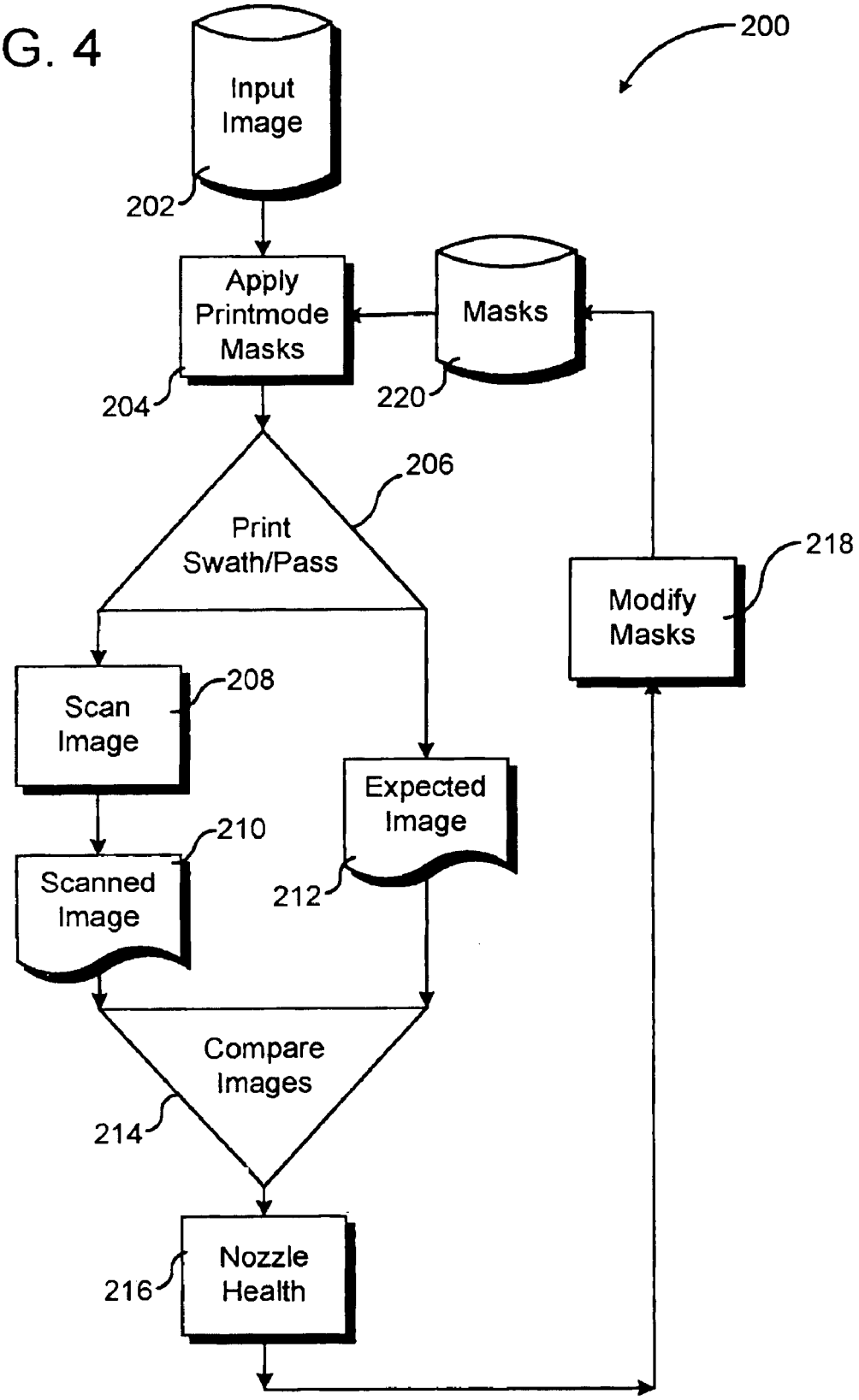
FIG. 4 is a simplified process flow diagram illustrating an exemplary process for printing and performing a nozzle heath assessment.

FIG. 4 is a simplified process flow diagram illustrating an exemplary process for printing and performing a nozzle heath assessment. Data for an input image is provided at 202. This data may define a swath of an image to be printed. The print mode masks are then applied at 204 to the input data, and a swath pass is printed at 206. As the pass is being printed, the image of the printed image is captured by the scanner module 80 at 208 to provide a scanned image 210. The scanned image is compared with the expected image 212 at 214, to provide an assessment of the nozzle health at 216. In one exemplary embodiment, using the information about the current swath printed (after masking), a target pattern can be generated (convoluting the image with the scanner transfer function) for a non-defect printing. The target pattern and the scanned image for the pass can be processed and compared (using image phase-correlation techniques to synchronize them spatially and cross-correlation to isolate the individual defects) and characterize the different parts of the nozzle array. Different health weights can be assigned depending on the magnitude of the difference from the printed image to the non-defect image.

If malfunctioning nozzles are detected, then the print mode masks are modified at 218 to compensate for the malfunctioning nozzle(s). For example, if a nozzle is defective, rows printed by that nozzle will be blank. Another nozzle can be assigned to print rows previously assigned to the defective nozzle (by a 1 in a print mode mask, for example). For example, there may be a back up table of masks to use if a given nozzle goes bad, i.e. so that instead of modifying a print mask, the printer retrieves a mask from memory to use. Exemplary techniques for adjusting or modifying masks to compensate for non-working nozzles are described in U.S. Pat. No. 6,443,556, the entire contents of which are incorporated herein by this reference.

Although the foregoing has been a description and illustration of specific embodiments of the invention, various modifications and changes thereto can be made by persons skilled in the art without departing from the scope and spirit of the invention as defined by the following claims.

What is claimed is:

1. A method for assessing nozzle health of a printhead nozzle array in a swath-type inkjet printing system, comprising:

printing a swath portion of an image with the printhead nozzle array carried by a moving carriage of the printing system, wherein said image is an image printed by the printing system during a normal printing mode in which test patterns are not printed;

optically scanning the printed swath portion to capture a scanned image, said optically scanning the printed swath portion comprises scanning the printed swath portion with an optical scanner carried by the moving carriage;

comparing an expected image of the swath portion of the image with the scanned image;

based on results of said comparing, assessing whether any nozzles of the nozzle array have malfunctioned.

2. The method of claim 1, further comprising:

changing a printing assignment of a malfunctioned nozzle to a properly operating nozzle to compensate for said malfunctioned nozzle.

3. The method of claim 1 wherein:

said printing said image portion comprises operating the printing system in a multipass print mode, wherein n swam passes of the printhead nozzle array are used to complete printing of a full swath of the image.

4. The method of claim 3, wherein said operating the printing system in a multipass print mode comprises applying different print mode masks to a set of image data defining a swath image to printed.

5. A method for assessing nozzle health of a printhead nozzle array in a swath-type inkjet printing system, comprising:

printing a swath portion of an image comprising operating the printing system in a muitlipass print mode, wherein n swath passes of the printhead nozzle array are used to complete printing of a full swath of the image;

optically scanning the printed swath portion to capture a scanned image, comprising capturing a swath image after each of said n passes;

comparing an expected image of the swath portion of the image with the scanned image;

based on results of said comparing, assessing whether any nozzles of the nozzle easy have malfunctioned.

6. A method for operating a swath-type printing system in a normal printing mode, comprising:

receiving print data defining an image to printed in the normal printing mode;

printing a swath portion of said image in a multipass print mode, wherein an array of fluid ejectors comprising an array of nozzles mounted on a printer carriage is scanned n times over a print medium to completely print the swath portion, each swath portion printed using multiple nozzles of said array and having multiple rows of image pixels;

as the carriage is scanned n times over the print medium, optically scanning the printed swath portion to capture n scanned images of printed data, wherein said optically scanning the printed swath portion comprises scanning the printed swath portion with an optical scanner carried by the moving carriage;

comparing expected images of the swath portion of the image with the scanned images to determine whether one or more nozzles of the nozzle array have malfunctioned;

taking a corrective action to mitigate print quality defects arising from a malfunctioned nozzle.

7. The method of claim 6, wherein said taking a corrective action comprises:

changing a printing assignment of a malfunctioned nozzle to a properly operating nozzle to compensate for said malfunctioned nozzle.

8. The method of claim 6, wherein said optically scanning said image portion comprises capturing a swath image after each of said n passes.

9. The method of claim 6, wherein said operating the printing system in a multipass print mode comprises applying different print mode masks to a set of image data defining a swath image to be printed.

10. The method of claim 6, wherein said taking a corrective action comprises conducting a service operation on said array.

11. A swath-type printer, comprising:

a carriage movable along a swath axis during printing operations;

a printhead carried by the carriage, the printhead including a plurality of fluid drop generators which eject fluid during printing operations onto a print medium;

an optical sensor carried by the carriage for capturing images of swath image portions printed by the printhead, said images comprising multiple rows of image pixels created by multiples ones of said fluid drop generators;

a control system which receives input print data defining a to-be-printed image in a normal printing mode, the control system generating commands for controlling the carriage and printhead in response to the input print data, the control system further comprising means for comparing said captured images of swath image portions to expected image portions to determine whether any of said fluid drop generators have malfunctioned.

12. The printer of claim 11, wherein the control system further comprises means for taking a corrective action when said comparing means indicates that one or more of said fluid drop generators has malfunctioned.

13. The printer of claim 12, wherein the means for taking a corrective action comprises means for reassigning image locations to which a malfunctioned drop generator had been assigned to a properly functioning fluid drop generator.

14. The printer of claim 11, wherein the printer includes a muitipass print mode, wherein printhead is passes n times over the print medium to completely print the swath portion.

15. The printer of claim 14, wherein the optical scanner captures a swath image after each of said printhead passes.

16. The printer of claim 11, wherein said printhead is an inkjet printhead and each of said plurality of drop generators includes a nozzle through which the fluid is ejected.

17. A printer, comprising:

a carriage movable along a swath axis during printing operations;

a printhead carried by the carriage, the printhead including a plurality of fluid drop generators which eject fluid during printing operations onto a print medium;

an optical sensor carried by the carriage for capturing images of swath image portions printed by the printhead during a normal printing mode, said images of swath image portions comprising multiple rows of image pixels created by multiples ones of said fluid drop generators;

an electronic control system which receives input print data defining a to-be-printed image during said normal printing mode, the electronic controller system generating commands for controlling the carriage and printhead in response to the input print data, the control system further comprising an electronic processor for comparing said captured images of swath image portions to expected image portions to determine whether any of said fluid drop generators have malfunctioned.

18. The printer of claim 17, wherein the control system is adapted to take a corrective action when said electronic processor indicates that one or more of said fluid drop generators has malfunctioned.

19. The printer of claim 18, wherein said corrective action comprises reassignment of image locations to which a malfunctioned drop generator had been assigned to a properly functioning fluid drop generator.

20. The printer of claim 17, wherein the printer includes a multipass print mode, wherein said printhead is passes n times over the print medium to completely print the swath portion.

21. The printer of claim 20, wherein the optical scanner captures a swath image after each of said printhead passes.

22. The printer of claim 17, wherein said printhead is an inkjet printhead and each of said plurality of drop generators includes a nozzle through which the fluid is ejected.

23. A computer program product, comprising:

a computer useable medium having a readable code means embodied in said medium for assessing nozzle health of a printhead nozzle array of a printer system carried by a moving carriage of the printing system, the computer readable code means for causing a computer controller to control the printer system to:

print a swath portion of an image normal printing mode using multiple nozzles of said nozzle array to print multiple rows of image pixels;

with an optical scanner carried by the moving carriage, optically scan the printed swath portion to capture a scanned image, said images of swath image portions comprising multiple rows of image pixels created by multiples ones of said fluid drop generators;

compare an expected image of the swath portion of the image with the scanned image;

based on results of said comparing, assess whether any nozzles of the nozzle array have malfunctioned.

24. The computer program product of claim 23, the computer readable code means for causing the computer controller to further control the printer system to:

change a printing assignment of a malfunctioned nozzle to a properly operating nozzle to compensate for said malfunctioned nozzle.

25. The computer program product of claim 23, wherein:

said printing said image portion comprises operating the printing system in a multipass print mode, wherein n swath passes of the printhead nozzle array are used to complete printing of a full swath of the image.

26. The computer program product of claim 25, wherein said optically scanning said image portion comprises capturing a swath image after each of said n passes.

27. The computer program product of claim 25, wherein said operating the printing system in a multipass print mode comprises applying different print mode masks to a set of image data defining a swath image to be printed.

* * * * *

UNITED STATES PATENT AND TRADEMARK OFFICE

CERTIFICATE OF CORRECTION

PATENT NO. : 7,287,824 B2
APPLICATION NO. : 10/892712
DATED : October 30, 2007
INVENTOR(S) : Francesc Subirada et al.

It is certified that error appears in the above-identified patent and that said Letters Patent is hereby corrected as shown below:

In column 9, line 27, in Claim 3, after “1” insert -- , --.

In column 9, line 30, in Claim 3, delete “swam” and insert -- swath --, therefor.

In column 9, line 35, in Claim 4, after “to” insert -- be --.

In column 9, line 40, in Claim 5, after “image” insert -- , --.

In column 9, line 41, in Claim 5, delete “muitlipass” and insert -- multipass --, therefor.

In column 9, line 50, in Claim 5, delete “easy” and insert -- array --, therefor.

In column 9, line 53, in Claim 6, after “to” insert -- be --.

In column 10, line 51, in Claim 14, delete “muitipass” and insert -- multipass --, therefor.

In column 10, line 51, in Claim 14, after “wherein” insert -- said --.

In column 11, line 22, in Claim 20, delete “passes” and insert -- passed --, therefor.

In column 11, line 31, in Claim 23, insert -- computer -- before “readable”.

UNITED STATES PATENT AND TRADEMARK OFFICE

CERTIFICATE OF CORRECTION

PATENT NO. : 7,287,824 B2
APPLICATION NO. : 10/892712
DATED : October 30, 2007
INVENTOR(S) : Francesc Subirada et al.

It is certified that error appears in the above-identified patent and that said Letters Patent is hereby corrected as shown below:

In column 12, line 3, in Claim 23, after "image" insert -- during a --.

In column 12, line 16, in Claim 24, after "means" delete "for causing" and insert -- causes --, therefor.

Signed and Sealed this

Fifth Day of August, 2008

JON W. DUDAS
*Director of the United States Patent and Trademark Office*